US006871423B2

(12) United States Patent
King, Jr.

(10) Patent No.: US 6,871,423 B2
(45) Date of Patent: Mar. 29, 2005

(54) SHOE LACING

(76) Inventor: Owen F. King, Jr., 144 N. Webster St., Omro, WI (US) 54963

( * ) Notice: Subject to any disclaimer, the term of this patent is extended or adjusted under 35 U.S.C. 154(b) by 0 days.

(21) Appl. No.: 10/383,403

(22) Filed: Mar. 7, 2003

(65) Prior Publication Data

US 2004/0172796 A1 Sep. 9, 2004

(51) Int. Cl.[7] ..... A43C 11/00; A43C 7/00; A43B 5/04

(52) U.S. Cl. ..... 36/50.1; 36/50.5; 24/712.9

(58) Field of Search ..... 36/50.1, 50.5, 36/132, 136; 24/712.1, 712.2, 712.3, 712.9, 129 R, 130

(56) References Cited

U.S. PATENT DOCUMENTS

| | | | | | |
|---|---|---|---|---|---|
| 574,484 | A | * | 1/1897 | Johnson | 36/50.1 |
| 722,891 | A | * | 3/1903 | Pitman | 24/712.1 |
| 3,290,745 | A | | 12/1966 | Maxwell et al. | |
| 3,537,151 | A | | 11/1970 | Sobel et al. | |
| 3,564,670 | A | | 2/1971 | Bengtsson | |
| 4,102,019 | A | | 7/1978 | Boden | |
| 4,879,787 | A | * | 11/1989 | Walls | 24/712.2 |
| 5,293,675 | A | | 3/1994 | Shai | |
| 5,335,400 | A | | 8/1994 | Sales | |
| 5,388,315 | A | | 2/1995 | Jones | |
| 5,402,589 | A | * | 4/1995 | Lubrani et al. | 36/50.1 |
| 5,806,153 | A | * | 9/1998 | Dolan et al. | 24/712.1 |
| 5,903,959 | A | | 5/1999 | Leonardi | |
| 5,924,177 | A | * | 7/1999 | Jongejan | 24/712.2 |
| 5,953,800 | A | * | 9/1999 | Duckett | 24/712.1 |
| 5,996,256 | A | * | 12/1999 | Zebe, Jr. | 36/50.1 |
| 6,044,527 | A | * | 4/2000 | Ishida et al. | 24/129 R |
| 6,112,380 | A | * | 9/2000 | Dolan et al. | 24/712.1 |
| 6,167,598 | B1 | | 1/2001 | Pransky et al. | |
| 6,185,798 | B1 | | 2/2001 | Ton | |
| 6,192,559 | B1 | | 2/2001 | Munsell, Jr. | |
| 6,282,817 | B1 | * | 9/2001 | Curet | 36/50.1 |
| 6,338,186 | B1 | | 1/2002 | Kleinmann | |
| 6,381,816 | B1 | | 5/2002 | Lai et al. | |
| 6,453,524 | B1 | | 9/2002 | Liu | |
| 6,453,525 | B1 | | 9/2002 | Liu | |
| 6,510,627 | B1 | | 1/2003 | Liu | |
| 6,536,086 | B2 | | 3/2003 | Liu | |
| 6,568,048 | B2 | | 5/2003 | Liu | |
| 6,568,103 | B2 | * | 5/2003 | Durocher | 36/50.1 |
| 6,571,437 | B2 | | 6/2003 | Liu | |
| 6,571,438 | B2 | | 6/2003 | Liu | |
| 6,581,256 | B2 | | 6/2003 | Liu | |
| 6,612,003 | B1 | | 9/2003 | Liu | |
| 6,681,460 | B2 | * | 1/2004 | Liu | 24/712.1 |
| 6,729,000 | B1 | | 5/2004 | Liu | |
| 2003/0024086 | A1 | | 2/2003 | Liu | |
| 2003/0024087 | A1 | | 2/2003 | Liu | |

FOREIGN PATENT DOCUMENTS

| | | |
|---|---|---|
| DE | DE 1909942 | 2/1965 |

* cited by examiner

*Primary Examiner*—Anthony Stashick
(74) *Attorney, Agent, or Firm*—Wilhelm Law Service; Thomas D. Wilhelm

(57) ABSTRACT

Shoe lacing kits, laced shoes, and methods of lacing shoes. First and second lacing elements are used to create lacing loops on the exterior of the shoe body. An end of each lacing element is anchored to the shoe body. The loops are threaded through a clasp. Pulling the loops in different directions draws the clasp toward the shoe, and tightens the lacing elements on the shoe. When the tightening force is released, one or more gripping elements in the clasp grip the lacing elements and hold the lacing elements in the tightened position. Releasing the gripping elements on the clasp releases the lacing elements from the tightened position such that the lacing elements can be loosened on the shoe.

49 Claims, 9 Drawing Sheets

SHOE LACING

BACKGROUND

This invention relates to shoes, and more particularly to lacing systems for shoes. Shoe laces have been used for many years, laced through a plurality of eyelets on opposing sides of an expansion opening, for the purpose of drawing shoes tightly about the foot of a wearer. However, the process of tightening and tying the lacing elements on shoes requires a threshold level of knowledge, as well as a threshold level of physical dexterity.

While the required threshold levels of knowledge and dexterity are not especially high, such requirements do present difficulties for those who are physically challenged such as young children, the physically handicapped and some elderly, and for those who are mentally challenged such as the mentally handicapped and young children.

While a number of alternative structures have been used, and are being used, in place of lacings, large numbers of shoes are still made with lacing eyelets, and lacings.

There are now available a variety of structures of eyelets, made from a variety of materials. There are available a number of arrangements of eyelets about the expansion opening. Lacings can be obtained in a variety of structures and materials. Lacings can be fixed length, or resiliently expansible.

In light of the ongoing consumer acceptance of lacings as closure devices for shoes, there is a need for improvements in use of lacings which facilitate use of lacings by those who are mentally or physically challenged with respect to use of lacings.

Thus, it is an object of the invention to provide a lacing kit which includes at least one lacing, defining first and second lacing elements, and a one-way clasp, wherein the lacing elements are passed through the clasp, with the clasp readily passing the lacing elements for tightening the lacing elements on the shoe, and holding the lacing elements tight on the shoe until release of the tightening is desired.

It is another object to provide such lacing kit wherein first and second apertures on the clasp operate as gripping structure, gripping and holding the lacing elements.

It is still another object to provide gripping structure which operates as a one-way mechanical closure on the clasp, optionally in combination with closing and opening of a cover on the clasp, and wherein the cover can optionally open and close about a hinge, and wherein the cover and a receptacle can latch to each other in the closed position, with opening of the cover operating to release the lacing elements from the gripping structure.

Still another object is to provide a clasp having a receptacle, and a cover which is separate and distinct from the receptacle, and which is separable from the receptacle for alternating closing of the clasp, and opening of the clasp for access to the receptacle.

Still another object is to provide lacing exit apertures on opposing sides of the clasp, optionally to provide clasp structure wherein the lacing elements pass through the clasp along first and second different paths, optionally wherein the paths are mirror-image paths.

Yet another object is to provide a mechanical holding device adapted for attachment to at least one of the lacing elements, for blocking passage of the respective lacing element through an eyelet of the shoe.

Still other objects are to provide shoes having lacing systems of the invention installed thereon, wherein each of the lacing elements is anchored to the shoe body, and the lacing elements pass through the clasp to define lacing loops emergent from the clasp.

Still another object is to provide methods of handling lacing operations on a shoe by anchoring lacing ends to the shoe body, pass lacing loops through a one-way clasp, and tighten the lacing elements, with the clasp holding the lacing elements tight until such time as release of the lacing elements is desired.

SUMMARY

First and second shoe lacing elements are threaded through terminal eyelets of the shoe, and ends of the lacing elements are anchored to the shoe body, with each lacing element defining a loop on the exterior of the shoe body adjacent the end of the lacing element. An end of each lacing element is thus anchored to the shoe body. The so-defined loops are threaded through a clasp. Pulling the loops, which exit the clasp, in different directions, preferably away from each other, draws the clasp toward the shoe body, and tightens the lacing elements on the shoe body. In some embodiments, gripping elements of the clasp automatically grip the lacing elements. In other embodiments, the lacing elements are brought into gripping engagement with the gripping elements through a separate operation. When the tightening force is released, with the gripping elements engaged, the gripping elements on the clasp grip the lacing elements and hold the lacing elements in the tightened position. Releasing the gripping elements on the clasp releases the lacing elements from the tightened position such that the lacing elements can be loosened on the shoe.

In a first family of embodiments, the invention comprehends a lacing kit. The lacing kit comprises at least one lacing defining first and second lacing elements, and a clasp. The clasp comprises a receptacle, at least one receiving aperture in the receptacle adapted to receive the first and second lacing elements, first and second exit apertures by which the lacing elements can pass out of the clasp, and gripping structure effective to grip the lacing elements to thereby temporarily prevent withdrawal of the lacing elements from the clasp.

In some embodiments, structure communicating with the first and second exit apertures operates at least in part as the gripping structure.

In some embodiments, the gripping structure is operable as a one-way mechanical lacing gripper, enabling the lacing elements to pass through the clasp along one or more paths extending away from the receiving aperture and preventing casual withdrawal of the lacing elements from the clasp.

In some embodiments, the lacing element can move in alternating opposing directions through the exit apertures when the clasp is configured for gripping the lacing elements, and wherein the gripping structure is in communication with the exit apertures such that the lacing elements can move between the exit apertures and the gripping structure when the clasp is configured for gripping the lacing elements.

In preferred embodiments, the lacing kit includes a cover closeable over the receptacle, and operative to position the gripping structure for engagement with the lacing elements when the cover is closed over the receptacle.

In some embodiments, the gripping structure comprises at least one slot in the clasp between the receptacle and the cover, expandable by translation of the cover with respect to the receptacle, and optionally comprises spaced openings on opposing sides of the clasp, in communication with first and second slots on opposing sides of the clasp.

In some embodiments, the cover is connected to the receptacle for pivotation with respect to the receptacle to bring the cover into closing engagement over the receptacle, and to open the clasp to provide access to the receptacle.

In other embodiments, the cover is a separate and distinct element, separable from the receptacle for alternating closing the clasp and opening the clasp for access to the receptacle.

Preferred embodiments further comprise latch structure on at least one of the receptacle and the cover, and the receptacle and cover are cooperatively structured such that closure of the cover over the receptacle, secured by the latch structure, positions the gripping structure for gripping engagement with the lacing elements.

In preferred embodiments, the receptacle and cover are structured such that raising the cover releases the lacing elements from engagement with the gripping structure.

In some embodiments, the clasp further comprises at least one loop retainer, preferably on the clasp, effective to engage operative ends of the first and second loops, thereby to prevent inadvertent withdrawal of the first and second loops entirely out of the clasp.

In preferred embodiments, the lacing kit further comprises a mechanical holding device adapted for attachment to at least one of the lacing elements and adapted to block passage of the respective lacing element through an eyelet of a shoe.

In preferred embodiments, the structure of the clasp enables passage of the lacing elements through the clasp from the at least one receiving aperture through the exit apertures along first and second different paths, preferably mirror-image paths, which emerge on opposing sides of the clasp.

In some embodiments, the first and second paths do not inherently cross inside the clasp.

In some embodiments, the clasp comprises first and second exit apertures on a first side of the clasp, and a first gripping slot between, and communicating with, the first and second exit apertures, the clasp further comprising third and fourth exit apertures on a second side of the clasp, and a second gripping slot between and communicating with the third and fourth exit apertures.

In some embodiments, the slots connect with the exit apertures at elevations displaced from vertical mid-points of the exit apertures, such that, when the lacing loops are pulled away from the clasp in horizontal directions, side edges of the exit apertures interfere with movement of the lacing loops into the slots.

In some embodiments, the slots connect with the exit apertures below the vertical mid-points of the exit apertures.

In a second family of embodiments, the invention comprehends, in combination, a shoe, and a lacing system incorporated into the shoe. The shoe comprises a shoe body, a left side and a right side, an aperture for inserting a wearer's foot therethrough for putting the shoe on and taking the shoe off, and an elongate expansion opening having a distal end in communication with the aperture. Left and right sides of the expansion opening are defined by left and right edges of respective left and right upper sides of the shoe body. A plurality of eyelets are arrayed along the left and right upper sides of the shoe body, adjacent the left and right edges of the expansion opening, including terminal eyelets adjacent the distal end of the expansion opening and next adjacent eyelets next adjacent the terminal eyelets. The terminal eyelets and the next adjacent eyelets are those eyelets closest to the distal end of the expansion opening and which are used for lacing purposes.

The lacing system comprises first and second lacing elements, including respective first and second lacing ends, laced through the eyelets along the left and right upper sides of the shoe body. The first and second lacing elements are anchored to the shoe body at anchor points positioned such that the respective lacing ends cannot, in routine lacing use, be displaced outwardly from the shoe body. The first and second lacing elements define first and second loops. The first and second lacing loops are threaded through a clasp along respective first and second different threading paths, with first and second loop ends emerging from the clasp. Each loop has a first loop element extending between the clasp and a first one of the eyelets, and a second loop element extending between the clasp and the shoe body or a second one of the eyelets. The first and second loops pass through the clasp along paths according to which pulling the first and second loop ends in first and second different directions draws portions of the loop elements through the clasp.

In some embodiments, the first and second loops are defined by lacing elements extending outwardly away from the shoe body through a next adjacent eyelet and thence inwardly through a terminal eyelet, optionally with at least one of the lacing elements anchored to the shoe body at a location on the respective lacing element which is between the respective lacing end and a portion of the lacing element which is adjacent the terminal eyelet.

In some embodiments, at least one of the lacing elements is anchored to the shoe body inside the foot-receiving cavity, optionally by a mechanical holding device.

In some embodiments, the mechanical holding device operates as an enlargement of the respective lacing element, thereby blocking passage of the lacing element at the respective eyelet.

In some embodiments, the mechanical holding device is secured to the lacing element and is anchored to the shoe body at a location displaced from the terminal eyelet.

In some embodiments, at least one of the lacing elements is anchored to the shoe body by adhesive.

In some embodiments, the lacing loops enter the clasp at relatively lower locations in use orientations of the clasp, and emerge from the clasp at relatively higher locations.

Preferably, the lacing loops traverse the clasp in non-crossing paths, and optionally traverse the clasp along mirror-image paths.

In preferred embodiments, the lacing loops enter the clasp through at least one receiving aperture, more preferably a centrally-disposed receiving aperture.

Preferably, the clasp comprises a receptacle receiving the lacing elements, and gripping structure which grips the lacing elements and thereby temporarily prevents withdrawal of the lacing elements from the clasp.

In preferred embodiments, the clasp further comprises a cover, and the cover can be opened and closed over the receptacle, and closing the cover positions the gripping structure for engaging the lacing elements.

In preferred embodiments, the receptacle and cover are structured such that raising the cover releases the lacing elements from engagement with the gripping structure.

In some embodiments, the gripping structure is defined at least in part by the cover.

In some embodiments, the gripping structure is defined at least in part by the receptacle.

Preferably, the cover is hingedly attached to the receptacle.

In some embodiments, the lacing loops enter the clasp through a receiving aperture and exit the receptacle at exit apertures on opposing sides of the clasp, and structures communicating with the first and second apertures operates, at least in part, as the gripping structure.

In some embodiments, the clasp comprises exit apertures, and the gripping structure is in communication with the exit apertures such that the lacing elements can move between the exit apertures and the gripping structure when the clasp is configured for gripping the lacing elements.

In some embodiments, the clasp comprises first and second exit apertures on a first side of the clasp, and a first gripping slot between the first and second exit apertures, the clasp further comprising third and fourth exit apertures on a second opposing side of the clasp, and a second gripping slot communicating with the third and fourth apertures.

In some embodiments, the slots connect with the exit apertures at elevations displaced from vertical mid-points of the exit apertures, such that when the lacing loops are pulled away from the clasp in horizontal directions, side edges of the exit apertures interfere with movement of the lacing loops into the slots.

In some embodiments, the slots connect with the exit apertures below the vertical mid-points of the exit apertures.

In some embodiments, the gripping structure comprises at least one slot in the clasp between the receptacle and the cover, expandable by translation of the cover with respect to the receptacle, optionally further comprising spaced openings on opposing sides of the clasp, in communication with the at least one slot.

In a third family of embodiments, the invention comprehends a method of handling lacing operations on a shoe. The shoe has a shoe body, a left side, a right side, an aperture for inserting a wearer's foot therethrough for putting the shoe on and taking the shoe off, and an elongate expansion opening having a distal end in communication with the aperture. Left and right sides of the expansion opening are defined by left and right edges of respective left and right upper sides of the shoe body. An array of eyelets is disposed along an upper portion of each of the left and right sides of the shoe body, adjacent the left and right edges of the expansion opening, including terminal eyelets adjacent the distal end of the expansion opening, and next adjacent eyelets next adjacent the terminal eyelets in each array. The terminal eyelets and the next adjacent eyelets are those eyelets closest to the distal end of the expansion opening and which are used for lacing purposes. The method comprises threading first and second lacing elements, including first and second lacing ends, through the eyelets along the left and right upper sides of the shoe body, including finishing the threading of each lacing element by establishing a loop of the respective lacing element, outside the foot-receiving cavity, between the shoe body and a corresponding eyelet adjacent the distal end of the expansion opening, so as to define first and second lacing loops which are disposed outside the shoe body and which can extend loosely between the respective eyelet and the shoe body The method further comprises anchoring each of the first and second lacing elements to the shoe body such that the respective lacing ends cannot, in routine lacing use, be displaced outwardly from the shoe body, and threading the first and second loops into and through a clasp along first and second different threading paths so as to establish first and second loop ends emerging from the clasp, each loop having a first loop element extending loosely between the clasp and a first one of the eyelets, and a second loop element extending loosely between the clasp and the shoe body or a second one of the eyelets, the first and second loops passing through the clasp along paths according to which pulling the first and second loop ends in first and second different directions can draw portions of the loosely-extending loop elements through the clasp.

The method still further comprises pulling the first and second loop ends in first and second different directions, preferably opposite direction, so as to draw the loosely extending loop elements through the clasp, thereby to draw the clasp toward the shoe body and tighten the lacing elements on the shoe body, and correspondingly to draw the left and right upper sides of the shoe body toward each other, along the elongate expansion opening; and engaging portions of the first and second lacing elements, at the lacing loops, with respective lacing gripping structure at the clasp, whereby the lacing gripping structure temporarily retains the lacing loops in the tightened configuration.

In preferred methods, the pulling of the first and second loop ends in the first and second different directions comprises pulling the respective loops from the clasp toward the respective left and right sides of the shoe body.

Preferred methods include threading the first and second loops through at least one centrally-disposed receiving aperture, optionally a common centrally-disposed receiving aperture.

The method preferably comprises releasing the lacing gripping structure from engagement with the lacing loops, and with the lacing loops so released, traversing the lacing loops backward through the clasp so as to re-establish the first and second loosely extending loop elements, whereby the loosely extending loop elements enable drawing the left and right sides of the upper portion of the shoe body away from each other at the elongate expansion opening thereby to enable expanding the expansion opening, which facilitates the wearer putting the shoe on or taking the shoe off.

In some embodiments, the method further comprises, to establish the first and second loops, threading the first and second lacing elements each outwardly away from the shoe body through a next adjacent eyelet and then inwardly through a terminal eyelet.

Preferred embodiments comprise anchoring at least one of the first and second lacing elements to the shoe body, preferably inside the foot-receiving cavity, at a location on the respective lacing element which is between the respective lacing end and a portion of the lacing element which is adjacent the terminal eyelet.

In some embodiments, releasing the lacing elements from engagement with the lacing gripping structure comprises moving a portion of the respective lacing element transversely along a slot in the clasp to an exit aperture sufficiently large to accommodate withdrawal of the lacing element.

In some embodiments, the clasp comprises a cover, and raising the cover effectively releases the lacing elements from the lacing gripping structure.

In some embodiments, the gripping structure is embodied, at least in part, in the cover, and raising the cover raises respective parts of the gripping structure away from the lacing elements of the loops.

In some embodiments, the method comprises engaging the lacing gripping structure by drawing the lacing elements tight while the lacing elements are engaged with one-way lacing gripping structure, and wherein the one-way lacing gripping structure, while so engaged, prevents the lacing elements from moving backward through the lacing gripping structure to loosen the lacing elements.

In some embodiments, the clasp comprises exit apertures on opposing sides thereof, and gripping slots communicating with the exit apertures at slot entrances, the pulling of the first and second loop ends in first and second different directions comprising pulling the loop elements out of alignment with the slot entrances.

In some embodiments, the method further comprises, when the lace elements are desirably tight on the shoe, moving the lacing loops into alignment with the entrances to the slots In some embodiments, the method comprises disengaging the lacing gripping structure by moving the lacing elements transversely along respective slots of the lacing gripping structure to exit apertures displaced from each other, the exit apertures having cross-section sizes sufficiently great to accommodate withdrawal of the lacing elements backward through the clasp so as to loosen the loops at the left and right sides of the expansion opening.

In some embodiments, tightening the lacing elements on the shoe comprises engaging latch structure on one of the cover and the receptacle with the other of the cover and the receptacle, and subsequently pulling the loop ends in opposing directions through the clasp.

In some embodiments, releasing the lacing elements from the clasp comprises moving opposing portions of each loop in opposing directions transversely across the clasp to exit apertures which are sufficiently large to accommodate withdrawal of the lacing element, and thence moving the lacing element backward through the clasp at the exit aperture.

In some embodiments, the retaining of the lacings in the clasp by the gripping structure being effected by pinching the lacing elements at the respective lacing gripping structure.

In some embodiments, the anchoring of a lacing element to the shoe body further comprises cutting off an end portion of the lacing element.

Figure 1:
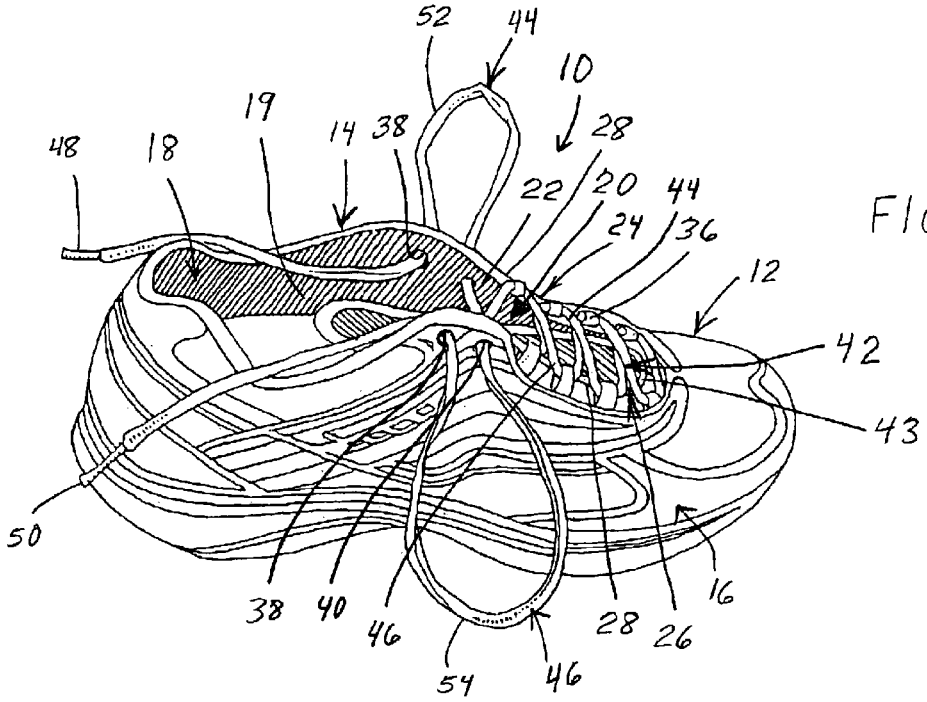
FIG. 1 shows a pictorial view of a first shoe and lacing system of the invention.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Figure 2:
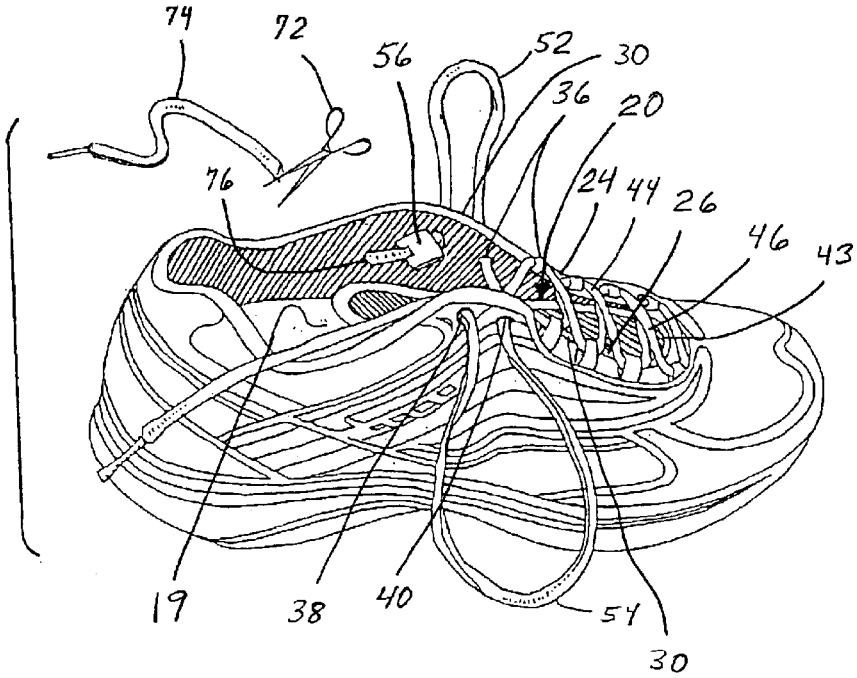
FIG. 2 shows a pictorial view of the shoe and lacing system of FIG. 1, illustrating cutting the end of one of the lacing elements and with the remaining end of the lacing element confined to the inside of the shoe body.

FIGS. 1 and 2 illustrate a shoe 10 in an early stage of using the lacing operation of the invention. FIG. 1 shows the shoe having a shoe body 12. Shoe body 12 has a left side 14 and a right side 16. An aperture 18 is provided for inserting a foot of a wearer into the foot-receiving cavity 19 of the shoe, for putting the shoe on and taking the shoe off. An expansion opening 20 has a distal end 22 in communication with aperture 18. Left 24 and right 26 sides of the expansion opening are defined by left 28 and right 30 edges of the left 14 and right 16 sides of the shoe body. An array of eyelets 36, illustrated as loops and through-apertures in FIGS. 1 and 2, is disposed along the upper portion of each of the left and right sides of the shoe body adjacent the left and right edges of the expansion opening. Each of the eyelet arrays includes a through-aperture terminal eyelet 38 adjacent distal end 22 of the expansion opening, and a through-aperture next adjacent eyelet 40 next adjacent the respective terminal eyelet. The terminal eyelet and the next adjacent eyelet are those eyelets which are closest to distal end 22 of the expansion opening and which are being used for lacing purposes.

FIG. 1 shows a single lacing 42 which includes first 44 and second 46 lacing elements which are threaded through eyelets 36 using a common lacing pattern up to and through the next adjacent eyelet. Lacing 42 can, of course, be replaced with two lacing elements, each anchored to the shoe body adjacent the proximal end 43 of the expansion opening.

In FIG. 1, each lacing element extends through the respective next adjacent eyelet along a path which passes from the inside of the shoe body outwardly and away from the shoe body.

Any lacing pattern can be used up to the next adjacent eyelet so long as the lacing elements pass through the next adjacent eyelets in directions which are permissive of simultaneously pulling on the first and second lacing elements, from the outer sides of the next adjacent eyelets, and thereby causing the lacing elements to draw the edges of the expansion opening toward each other, thus to reduce the space across the expansion opening, in a typical manner of tightening the shoe on the foot of a wearer.

In the embodiment illustrated in FIGS. 1 and 2, with the first and second lacing elements thus passing through the next adjacent eyelets from inside the shoe body, and passing through the shoe body in an outward direction, the lacing elements are then threaded through the terminal eyelets in a direction wherein the lacing elements pass from outside the shoe body, through the shoe body at the terminal eyelets, and into the foot-receiving cavity. With the lacing elements threaded loosely through the terminal eyelets in the recited directions, each lacing element forms a lacing loop which extends outwardly of the shoe body between the respective terminal eyelet and the corresponding next adjacent eyelet. Depending how much of the lacing element has been drawn through the terminal eyelet, the left 48 and right 50 lacing ends can be e.g. inside the foot-receiving cavity, or generally outside the shoe body as shown in FIG. 1. In any event, once the lacing elements have been laced through the terminal eyelets, and before the lacing elements have been drawn tight against the shoe body, each lacing element forms one of the lacing loops. FIG. 1 shows the respective lacing loops as a left lacing loop 52 and a right lacing loop 54.

FIG. 2 illustrates the next stage in the process of setting up the lacing system of the invention. As seen in FIG. 2, a mechanical holding device 56 has been attached to the end of the first lacing element. Holding device 56, and its relationship with the lacing element, is further illustrated in FIGS. 3A and 3B.

Figure 3A:
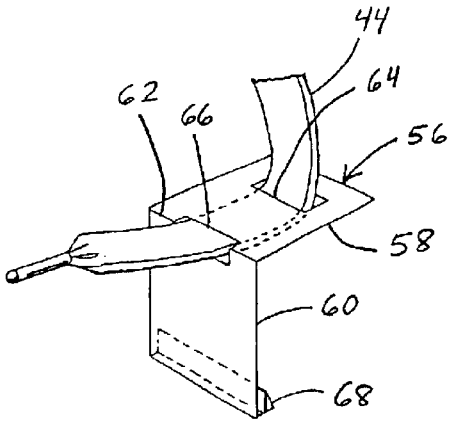
FIGS. 3A and 3B illustrate a mechanical holding device, also seen in FIG. 2, which holds the end of a lacing element inside the shoe body.
Figure 3B:
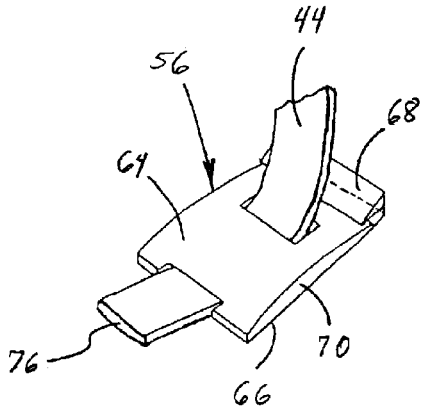

As seen in FIGS. 3A and 3B, holding device 56 has a first panel 58, and a second panel 60 hingedly joined to panel 58 at hinge element 62. Holding device 56 has a first aperture 64 in first panel 58 and a second aperture 66 at hinge element 62. A latch 68 is disposed on the distal end of second panel 60. As illustrated in FIG. 2, end 48, and thus first lacing element 44 are threaded into the holding device at first aperture 64, and out of the holding device at second aperture 66, whereby a length of the lacing element extends across first panel 58.

With the lacing element in place, the second panel is closed on the first panel, and latch 68 is engaged to thereby latch the second panel closed on the first panel. With the second panel thus closed on the first panel, holding device 56 comprises a cavity 70 between the first and second panels. As shown in FIG. 3B, lacing element 44 passes through the cavity.

Holding device 56 is made of a material which is sufficiently rigid that, with the second panel closed and latched on the first panel, the first and second panels grip the lacing element sufficiently e.g. at apertures 64, 66, to prevent the lacing element from being withdrawn from the holding device while the holding device is so closed and latched, thus to block passage of the lacing element through the eyelet. For example, a variety of thermoplastic materials can be selected, such as various ones of the polyolefins, for example, polyethylene, polypropylene, and the like for use in fabricating holding device 56. As desired, hinge element 62 can be made from the same material as the first and second panels, or can be different, as known in the art of hinging thin-section polymeric elements. Panels 58, 60 can be any thicknesses desired so long as the panels can be hinged as described, and are effective to grip the lacing element. A range of thicknesses can be so defined for each material which is suitable for use in the holding device; and the range of thicknesses depends on the material selected for use in making the holding device, and such ranges are known to those skilled in the plastics, and like, arts.

With holding device 56 so secured on lacing element 44, such that the lacing element cannot be drawn through the holding device, the lacing element is effectively anchored to the shoe body by the holding device such that the lacing element cannot be withdrawn from the shoe body through the terminal eyelet. Neither can that portion of the lacing element, which is inward, in the shoe, of the holding device 56, be withdrawn from the shoe body through terminal eyelet 38. With the lacing element so secured to the shoe body, the lacing element is cut adjacent the holding device as illustrated at scissors 72 in FIG. 2, whereby a cut-away end portion 74 of the lacing element is removed and discarded, and a new lacing end 76 is created. Lacing element 46 is similarly secured such that the new lacing end 76 is prevented from passing outwardly through the terminal eyelet.

Any number of structures and procedures can be used for retaining the new lacing ends, or the original lacing ends if end portion 74 is not cut away, inside the shoe body, or otherwise anchored to the shoe body so as to provide an anchor point beyond which the lacing element cannot be withdrawn from the terminal eyelet, loop, or other eyelet substitute structure.

For example, in the illustrated embodiment of FIG. 2, the holding device prevents the new lacing end from being withdrawn through the terminal eyelet, but does not prevent movement of the new lacing end further inwardly of the terminal eyelet than shown, and accommodates temporarily drawing any desired further length of the lacing element inwardly through the terminal eyelet. Thus, the lacing element is anchored to the shoe body at a location on the lacing element which is between the lacing end and a portion of the lacing element which is adjacent the terminal eyelet, while being free to move inwardly of the shoe body. In such case, the word "anchored" is permissive of inward movement of the lacing element relative to terminal eyelet 38.

In the alternative, the lacing element can be otherwise anchored to the shoe body. For example, an alternative enlargement can be created or placed, and preferably fixed, on or in the lacing element at the location on the lacing element which represents/defines an extremity of an end portion of the lacing element which is to be retained inside the foot-receiving cavity of the shoe body. Such enlargement can be, for example, any structure which can be so secured to the lacing element as to prevent the lacing element from being withdrawn back through the terminal eyelet. Thus, there can be mentioned a wide variety of clasps, clips, brackets, clamps, and the like.

In a simple embodiment, the lacing element can be knotted on itself to create an enlargement in the lacing element, whereby the knot is suitably large to block passage of the lacing element entirely out of the foot-receiving cavity through the terminal eyelet.

In yet another set of embodiments, a selected location on the lacing element, e.g. adjacent the lacing end, can be fixedly secured to the shoe body, either at the outside surface of the shoe body, e.g. adjacent an eyelet, or inside the shoe body after passing through an eyelet. Any suitable device can be used to anchor the lacing element to the shoe body. There can be mentioned, for example, a button on one of the shoe body and the lacing element, and a corresponding hole on the other of the lacing element and the shoe body. There can be mentioned cooperating male and female snaps on the respective lacing element and the shoe body. A clip can be mounted on the shoe body for gripping the lacing element, or on the lacing element for gripping the shoe body, for grasping and fixedly holding the lacing element and the shoe body to each other. Any securing device which securely defines an end of the respective loop, which cannot be displaced from the shoe body, is acceptable.

As a further alternative, the lacing element can be anchored to the shoe body e.g. at a location displaced from the terminal eyelet such as by adhesive or mechanical anchoring structure, either inside the foot-receiving opening, or on the outside surface of the shoe body.

Typically, where the end of the lacing element is anchored to the shoe body inside the foot-receiving cavity, the end of the lacing element extends through the shoe body at the terminal eyelet, or other opening in the shoe body, in passing into the foot-receiving cavity.

As yet another option, the effective end of the lacing element can be affixed to the shoe body, for example but without limitation to the outside surface of the shoe body, at a location displaced from the terminal eyelet, so long as the effective end of the lacing element cooperates with the next eyelet in forming a loop of the lacing element.

In such embodiments where the effective end of the lacing element is anchored to the shoe at a location displaced from the traditional location of the terminal eyelet, then the opposing end of the lacing loop can pass through any desired eyelet at the distal end of the lacing pattern. Thus, for example, the lacing element can pass through the terminal eyelet and thence be anchored to the shoe body at a location, preferably on the exterior of the shoe body, which is convenient to formation and manipulation of lacing loops 52, 54. In such case, the portion of the loop which is shown in FIGS. 1 and 2 as passing outwardly through the shoe body at next adjacent eyelet 40, instead passes outwardly through the shoe body at the structure which is designated as terminal eyelet 38.

As a general statement, then, the proximal end of the loop must pass through an eyelet, or eyelet equivalent, which can be any desired eyelet at the distal end of the lacing pattern; and the distal end of the loop must be affixed to the shoe body, sufficiently close to the proximal end of the loop, inside or outside the shoe body, to establish the function of the loop, and to the extent that the loop cannot be rendered ineffective by pulling the distal end of the loop away from the shoe body.

Whatever the mechanism for holding the end of the lacing element to the shoe body, that portion of the loop, which connects to the remainder of the lacing pattern, as the lacing element is laced through the remaining eyelets, extends through an eyelet or other structure in the shoe body which accommodates free passage of lengths of the lacing element therethrough as the lacing element is tightened on the shoe body, and loosened with respect to the shoe body. In the embodiment illustrated in FIG. 2, the loops are defined by lacing elements which extend outwardly away from the shoe body through the next adjacent eyelet 40 and thence inwardly through the terminal eyelet 38. The resulting loops in FIG. 2 traverse from the next adjacent eyelet to the terminal eyelet on the exterior of the shoe body, preferably but without limitation, without crossing over the edge 28 or 30 of the side of the shoe body.

As used herein, and in the claims which follow, except where otherwise designated, the words "eyelet" and "eyelets" refer to the full range of structures which are, and can be, used in developing a lacing pattern on a shoe, or in otherwise holding lacing elements on a shoe in such a way that pulling on the lacing elements tends to close the expansion opening. Thus, there can be mentioned lacing apertures through the shoe body, such as shown at terminal eyelet 38 and next adjacent eyelet 40. Such apertures can be, in addition, lined with apertured rivets or grommets, or not. There can be mentioned lacing loops made of fibrous fabric, as shown in FIGS. 1 and 2 between eyelet 40 and the front of the shoe. Such lacing loops can be oriented, as shown, such that the apertures, through such loops pass, are generally oriented for passage of a lacing element through such apertures in a direction generally oriented along the length of the shoe, or in any other direction, such as across the width of the shoe. The loops can be metal loops, plastic loops, or other material, as alternatives to fabric loops.

In the alternative, the shoe can be structured with e.g. metal hooks in place of some or all of the eyelets or lacing loops.

All such lacing structures, which are part of the shoe, and all equivalents thereof, are thus included in the word "eyelets."

Figure 8:
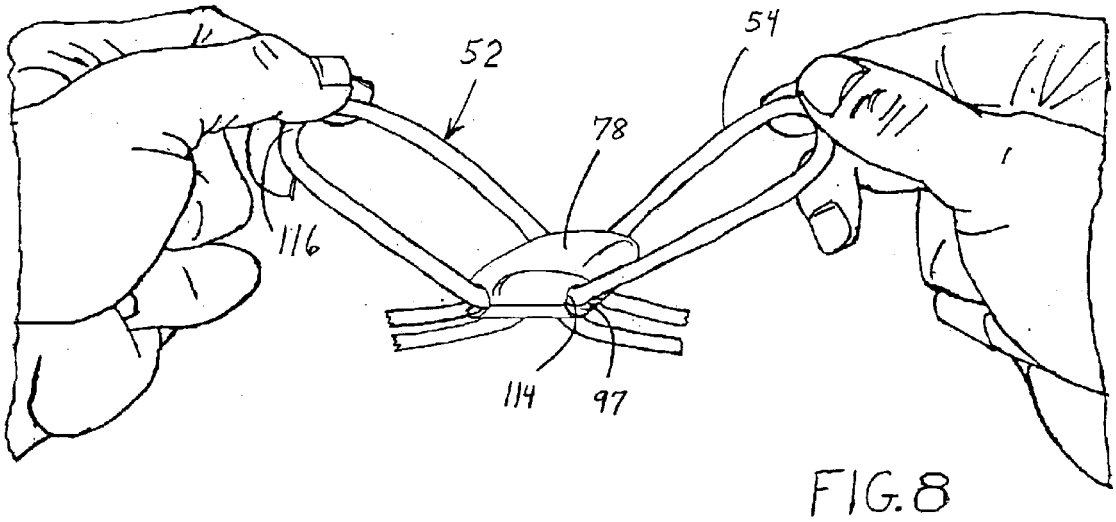
FIG. 8 shows the stage of tightening the lacing elements on the shoe of FIGS. 6 and 7, with the lacing loops raised relative to the clasp, and not yet being gripped by the gripping elements of the clasp.
Figure 10:
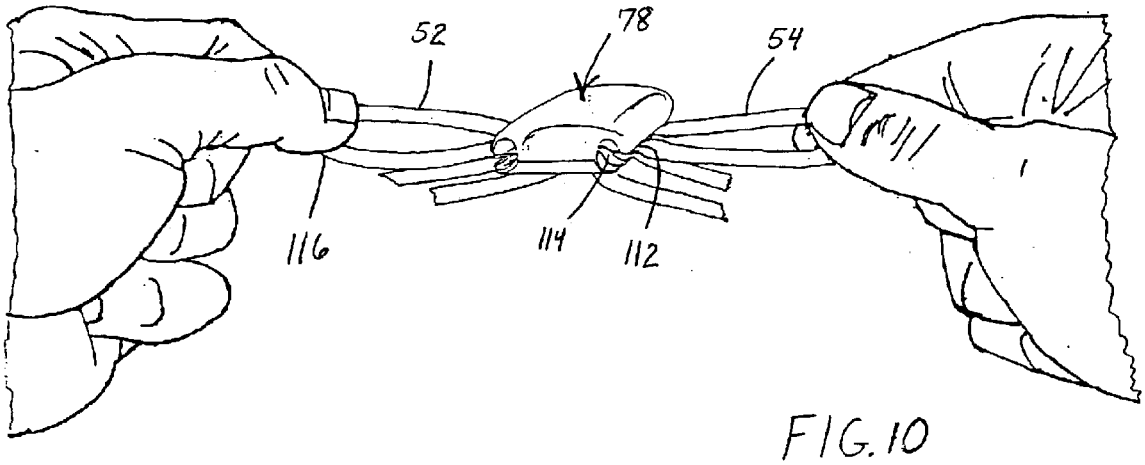
FIG. 10 shows an enlarged pictorial view of the clasp and lacing loops, with the lacing loops having been drawn tight and gripped by the gripping elements as in FIG. 9.
Figure 9:
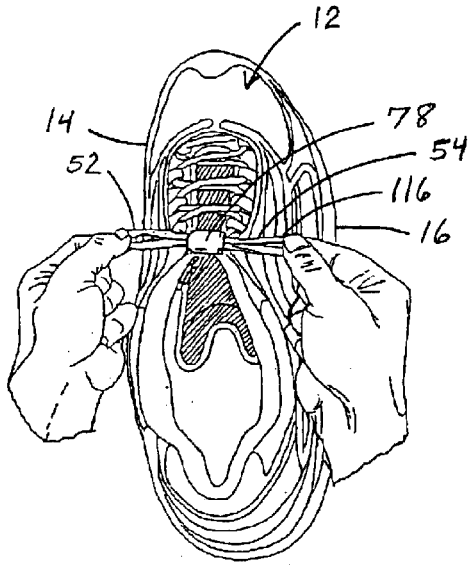
FIG. 9 shows a top pictorial view of the shoe lacing system of FIGS. 6–8, wherein the lacing elements have been pulled tight, and the lacing loops have been lowered, relative to FIG. 8, so as to pass the lacing loops into gripping engagement with the gripping elements in the slots.

With the ends of lacing elements 44 and 46 anchored to the shoe body, and loops 52 and 54 so established that the ends of the loops cannot be displaced from the shoe body, loops 52, 54 can be threaded through a clasp 78. Clasp 78 is illustrated in open configuration in FIG. 4, and in closed configuration in FIG. 5. Initial threading of the lacing loops through the clasp is illustrated in FIG. 6. The threaded clasp is shown closed in FIG. 7. The tightening of the lacing loops, and thus drawing of the sides of the shoe body together on the foot of a wearer, is illustrated in FIG. 8. Engaging the lacing elements to the gripping elements is illustrated in FIGS. 9 and 10

Figure 4:
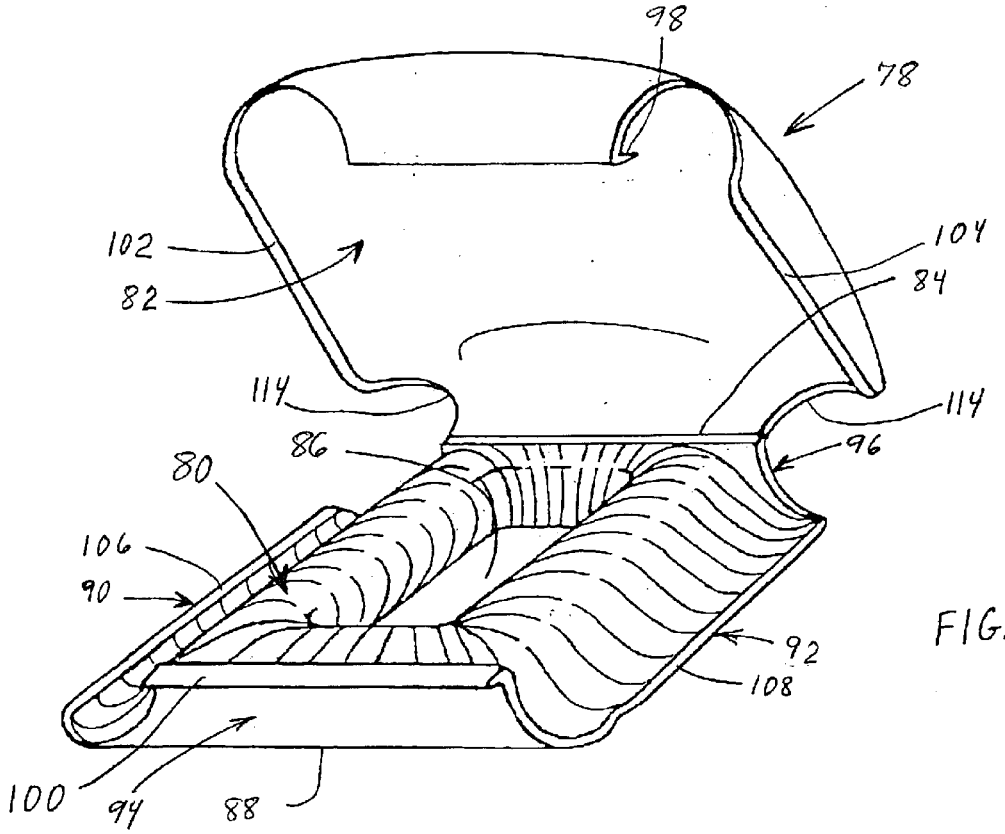
FIG. 4 shows a pictorial view of a first embodiment of a clasp useful in lacing systems of the invention, with the cover open

Returning to FIG. 4, clasp 78 includes a receptacle 80 and a cover 82. Cover 82 is connected to receptacle 80 by hinge 84, for pivotation with respect to hinge 84 so as to bring the cover into closing engagement over the receptacle, and to open the clasp to provide access to the receptacle. As seen in FIG. 4, receptacle 80 has a centrally-disposed receiving aperture 86 at the bottom 88 of the receptacle, and left 90 and right 92, and front 94 and back 96 sides extending away from the receiving aperture, the left, right, front, and back sides of the receptacle corresponding to left, right, front, and back sides of the clasp.

As seen in FIG. 4, cover 82 is hingedly attached to the receptacle, through hinge 84, at the back side edge of the receptacle. Correspondingly, a distal end of the cover extends over the front edge of the receptacle. A cover latching element 98 is disposed on the distal end of the cover. A receptacle latching element 100 is disposed on the front edge of the receptacle.

In the alternative, the latch structure can be confined to one or the other of the receptacle and the cover, whereby the other of the cover and the receptacle represents a passive element with respect to latching the cover and the receptacle to each other.

Figure 5:
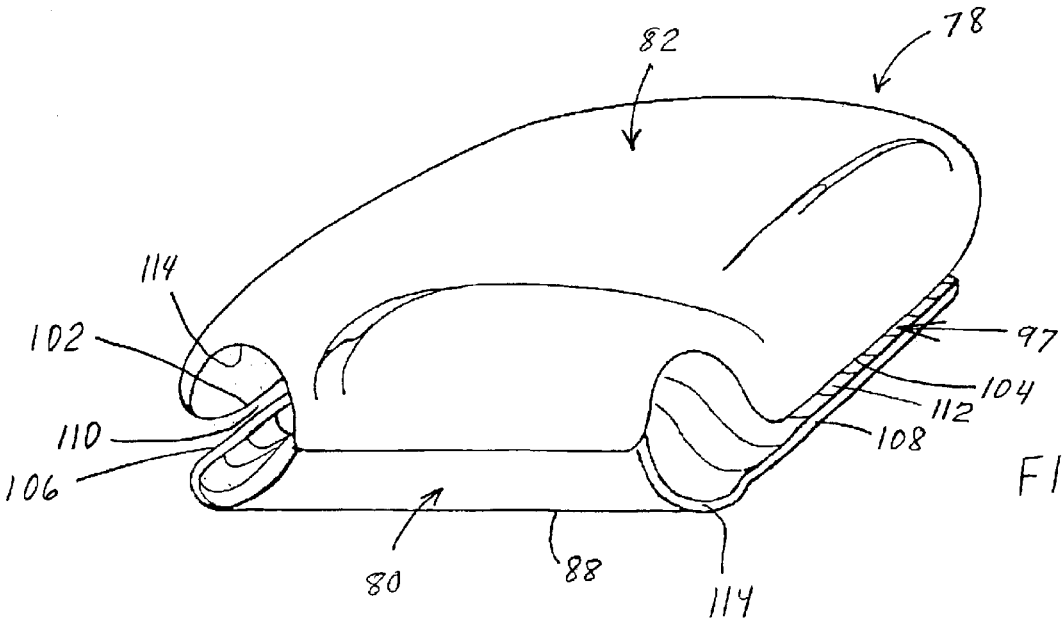
FIG. 5 shows the clasp of FIG. 4, with the cover closed on the receptacle, and latched.
Figure 6:
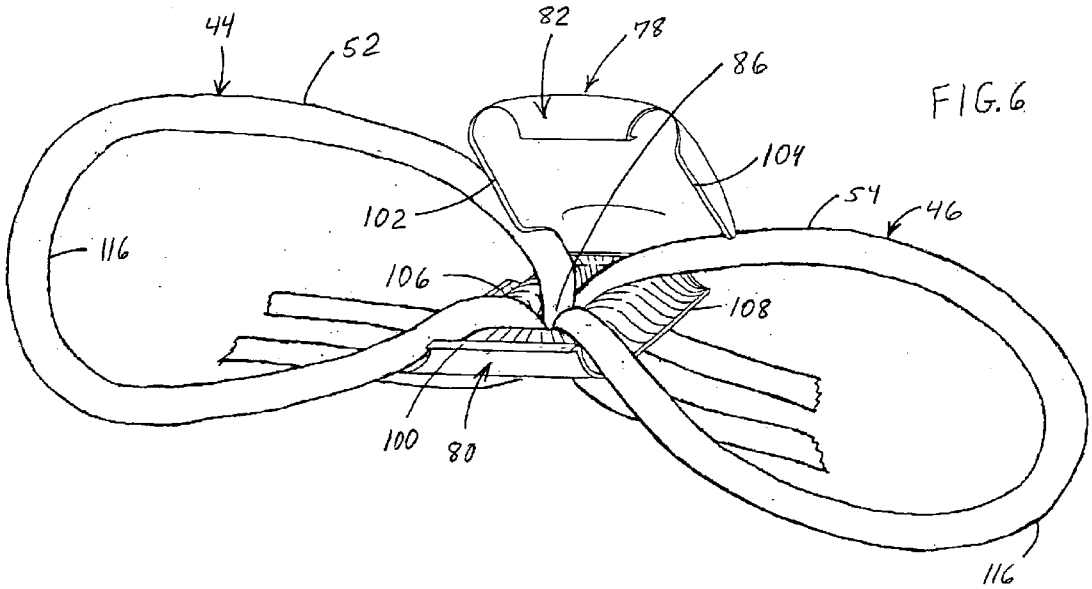
FIG. 6 shows lacings as threaded onto a shoe, with first and second lacing loops threaded into the clasp of FIGS. 4 and 5, with the cover open.

Latching elements 98 and 100 collectively define cooperative latch structures which can be latched to each other when the cover is closed on the receptacle as illustrated in FIG. 5. Closure of the cover over the receptacle, secured by the latch structure, brings the edges of the receptacle and cover together to define gripping structure 97 at the left and right edges of the receptacle cover.

The respective side edges of the receptacle and cover are generally rigid so as to be generally non-flexible in normal use. At each side of the clasp, the collective edges of the receptacle and cover define a slot between the edges. The distance across the slot, between the edges, is sized such that a lacing element 44, 46 in the slot is effectively pinched between the edges of the receptacle and cover. Such pinching action constitutes one form of the above noted gripping, wherein the side edges operate as the gripping elements.

In the alternative, one of the receptacle side edge and the cover side edge can project toward the other of the cover and the receptacle, while the other of the receptacle side edge and the cover side edge projects away from the projecting edge, and presents a more flattened or blunt surface against which the projecting edge can pinch the lacing elements.

As illustrated in the embodiment of FIG. 5, with the cover closed on the receptacle, left 102 and right 104 side edges of the cover overlie respective left 106 and right 108 side edges of the receptacle. A left slot 110 is defined between left side edge 102 of the cover and left side edge 106 of the receptacle. A right slot 112 is defined between right side edge 104 of the cover and right side edge 108 of the receptacle. Exit openings 114 between the cover and receptacle are disposed at the respective four corners of the clasp on opposing ends of slots 110 and 112, and are in communication with the slots. In addition, apertures 114 are so positioned relative to slots 110, 112, that the slots connect with apertures 114 at elevations displaced from the vertical mid-portions of the apertures. With the loops threaded through, and extending outwardly from, the clasp, and with the clasp closed and latched, the lacings/lacing elements are ready for use in tightening the shoe on the wearer's foot. At that stage, each loop has a first loop element extending at least somewhat loosely between the clasp and a first one of the eyelets, and a second loop element extending at least somewhat loosely between the clasp and the shoe body or a second one of the eyelets. The lacing elements are then tightened by grasping the loops as illustrated in FIG. 8 and pulling the ends 116 of the loops in different directions which do not tolerate movement of the lacing loops into slots 110, 112. FIG. 8 shows the loops being drawn in generally opposing left and right directions, each with an upward vector.

As the user pulls on loop ends 116, elements of the respective lacing elements move lengthwise through apertures 114 and thus through the clasp. As the lacing elements are drawn through the clasp, any loose portions of the lacing elements between the clasp and the shoe body are drawn through the clasp, the clasp is drawn toward the shoe body, and the lengths of the lacing elements are progressively drawn through the clasp.

In FIG. 6, the slots are positioned generally below the vertical mid-points of the openings defined by apertures 114. The critical relationship is that, starting with the loops extending out of apertures 114 as in FIG. 7, when loops 52, 54 are pulled outwardly, at angles out of alignment with the entrances from apertures 114 to slots 110, 112, for example, an upward vector/angle as shown in FIG. 8, the lacing elements 44, 46 pass freely through apertures 114, and the structure and positioning of the slots 110, 112 is such that, in spite of the force urging the lacing elements toward slots 110, 112, the lacing elements do not move transversely into slots 110, 112.

Thus, a typical tightening of the lacing elements on the shoe, and corresponding tightening of the shoe body on the foot of the wearer, accompanied by drawing clasp 78 tight against the shoe, is accomplished by grasping loops 52, 54 as shown in FIG. 8, and puling the loops away from each other. The pulling force preferably is horizontal or has an upward vector.

Such pulling has a transverse component urging side-by-side strands/legs of each loop toward each other and thus toward and into slots 110, 112. But because of the low positioning of the slots relative to apertures 114, the side edges of apertures 114 interfere with movement of the loop material into the slots. Similarly, the openings from apertures 114 into slots 110, 112 are so constrictive as to cooperate in interfering with movement of the loop material into the slots until the loops are lowered.

Once loops 52, 54 have been pulled as tight as desired, once the lacing elements are as tight as desired on the shoe, the user moves the ends of the loops, while still held tight, in a downward direction relative to the bottom of the clasp as at FIG. 10. As the loops move down, toward the bottom of the clasp, the loop elements at apertures 114 move downward correspondingly with respect to the apertures and into alignment with the entrances to slots 110, 112, toward the bottoms of the apertures. With the loop elements at the entrances to the slots, the transverse vectors of the pulling forces cause the loop elements to move transversely into the slots. As the loop elements move into the slots, they move into pinching engagement with the respective pinching edges 102, 104, 106, 108 of the cover and receptacle, wherein an ad hoc identifiable distinct locus on the length of a given loop element becomes pinched as the loop element enters the slot. With the loop element so pinched, the pinched locus of the loop element can move transversely along the slot, but the loop element cannot move along its length through the slot. Namely, the pinching effect on the loop element is such that the loop elements are securely held in the slot by the gripping edges of the cover and receptacle, secure against longitudinal movement of the loop elements/lacing elements.

Openings 114 are sufficiently large to accommodate lengthwise movement of the lacing elements through the openings in either the forward direction, which tightens the lacing elements on the shoe, or the backward direction, which loosens the lacing elements with respect to the shoe. Slots 110, 112 are sufficiently small, and the edges of the cover and receptacle sufficiently rigid, that lengthwise movement of the lacing elements through the slots in either the forward direction or the backward direction are effectively estopped.

Figure 7:
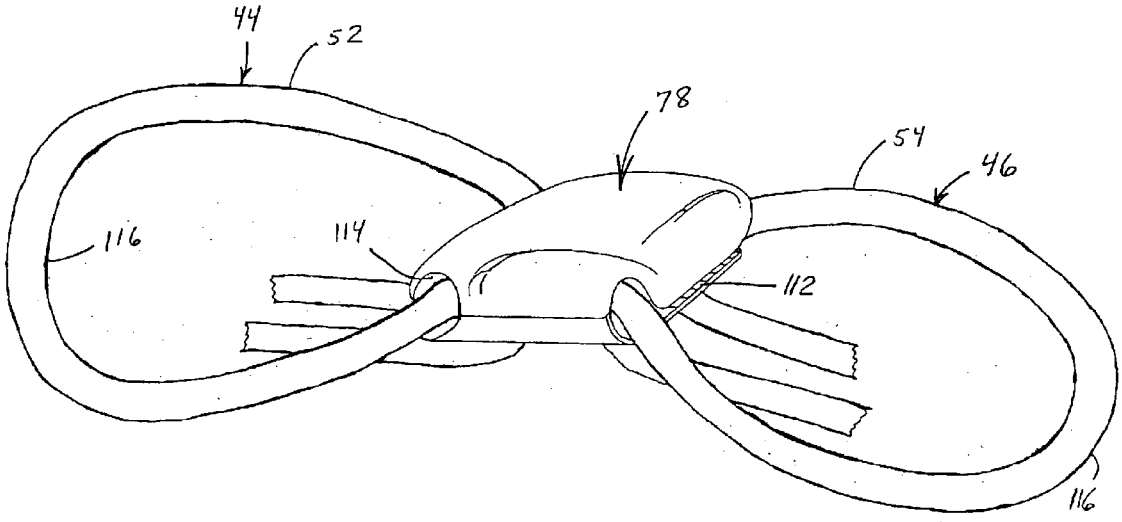
FIG. 7 shows the lacing loops and clasp of FIG. 6 with the lacing loops fully threaded through the clasp, and with the cover closed and latched, but wherein the loops extend through the openings on the ends of the slots, and are not yet being gripped by the clasp.

As illustrated in FIGS. 6 and 7, lacing loops 52, 54 follow first and second different threading paths through clasp 78 entering the clasp at a relatively lower location at receiving aperture 86 and emerge from the clasp at relatively higher locations at exit apertures 114 and when tightened, at slots 110, 112. The paths traversed by the lacing loops through the clasp preferably do not inherently cross, and are typically mirror-images of each other. However, it is entirely acceptable in the invention that the paths can cross and/or that the paths are not mirror-images of each other.

It should be noted that the lacing loops generally extend through openings 114 when the clasp is closed and, after tightening, are moved into slots 110 and/or 112 by lowering the loops while maintaining the tightening/pulling force, thus the tension, on the loops. Once the loops move into slots 110, 112, the slots operate as gripping structure.

The lacing elements can be drawn as tight as desired on the shoe, such that the lacing elements draw expansion opening 20 closed on the foot of the wearer, and draw the clasp tightly against the shoe body. With the lacing elements so tightened, and the clasp drawn as tightly as desired against the shoe body, the user moves the loop elements of the lacing elements into the slots and relaxes the pulling force on the lacing loops.

Before drawing on the loop ends in tightening the lacing elements on the shoe and clasp, one can, of course, pull on the loose lacing elements between the clasp and the shoe to thereby initiate closure of the expansion opening about the foot of the wearer. It can be especially helpful to pull on the lacing element which is positioned between the clasp and the eyelet positioned toward the proximal end of the expansion opening, thus to snug the lacings in the eyelets which are typically arrayed along the edge of the expansion opening.

When the user does pull on the loop ends, it is helpful to first draw any loose lengths of the lacing elements into and through the clasp. As the loops are pulled, it is helpful to let the two strands or legs of a given loop be pulled through the clasp independently, so as to tighten both legs of the loop simultaneously. The end 116 of a lacing loop is defined dynamically, and changes locations on a given lacing element according to those lengths of the loop which are emergent from the clasp at the given time. Thus, as a lacing loop is drawn through the clasp, and tightened, the location, on the lacing element, of the respective loop end 116 can change as the loop is being pulled. Thus, the user can well let the loop end slip through his/her fingers as the loop is tightened. For example, the user can insert a finger in the loop and pull with that finger, whereby the loop end 116, e.g. the length of the loop, is free to move with respect to the finger as the loop is tightened.

When it is desired to loosen the lacings such as to remove the shoe from the foot of the wearer, latching elements 98, 100 can be released from each other, and the cover raised, which translates the cover with respect to the receptacle, expanding the distance between the edges of each of the slots, and releasing the loops, and thus the lacing elements, for complete removal of the lacing elements from the clasp. Thus, raising the cover releases the lacing elements from engagement with the gripping structure.

Figure 11:
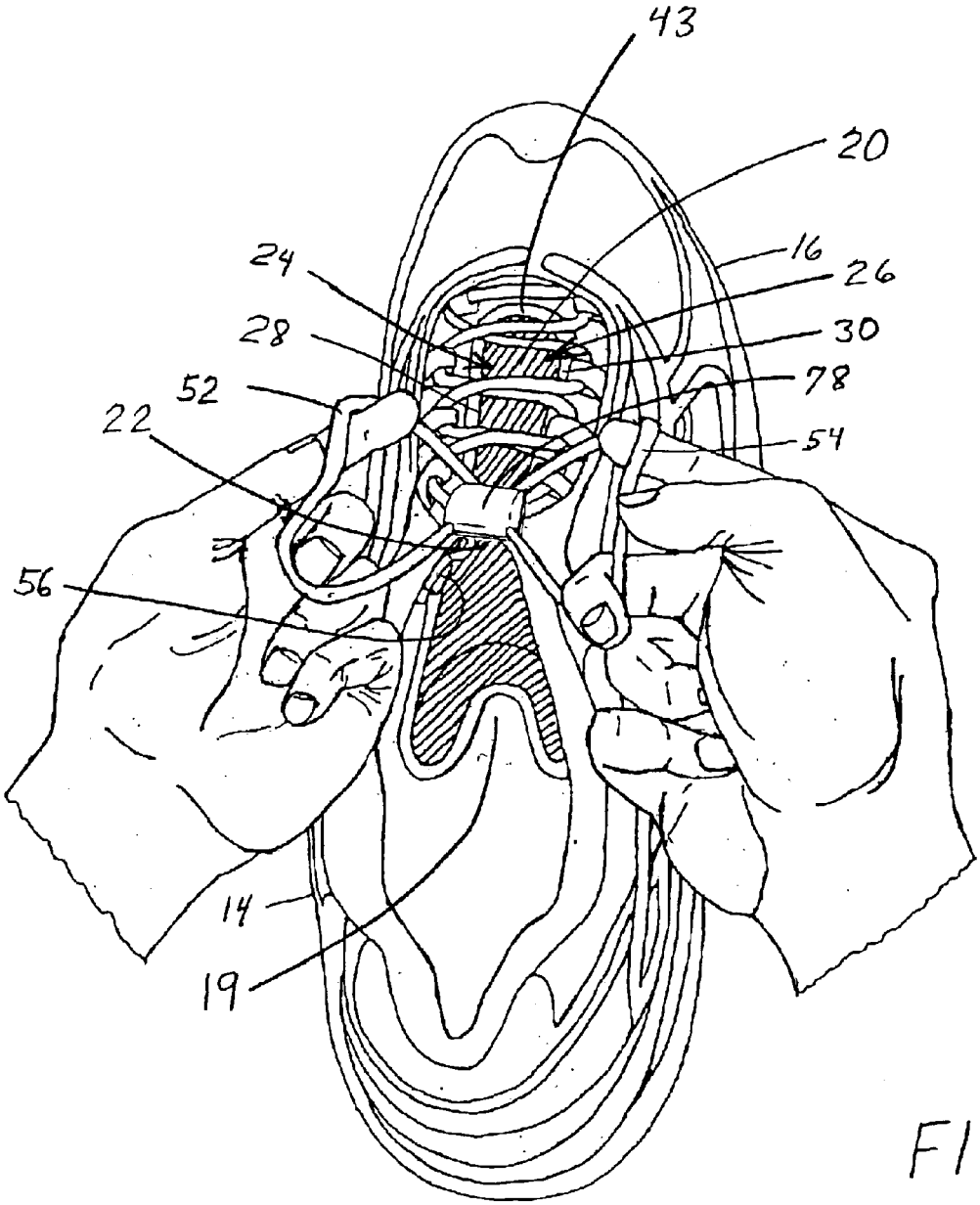
FIG. 11 shows a top pictorial view of the shoe lacing system of FIGS. 6–9, initiating release of the lacing elements from the gripping control of the clasp, wherein the lacing loops have been moved laterally from the gripping condition of FIGS. 9 and 10, and to a condition similar to the condition shown in FIG. 7.

In the alternative, and preferably, the user can grasp the loops as shown in FIG. 11, and move opposing legs of each loop in opposing directions transversely across the clasp, along the slots, to respective ones of the openings 114. Once the loop elements reach the openings 114, the lacing elements, which define such loop elements, are free to move backward through the openings, through the inner cavity of the clasp, and through the receiving aperture and out of the clasp.

However, as the ends of the loops are thus drawn toward the clasp, the loops are drawn about the side edges of the cover and the receptacle and become lodged in slots 110 and 112, which prevent the ends of the loops from passing into the inner cavity of the clasp. The slots thus operate as loop retainers to prevent the ends of the loops from unintentionally, casually passing out of, being withdrawn from, the clasp.

Clasp 78 can be made of a material which is sufficiently rigid that, with the cover closed and latched on the receptacle, the gripping elements grip the lacing elements sufficiently to prevent the lacing elements from being withdrawn from the clasp while the clasp is so closed and latched.

For example, a variety of thermoplastic materials can be selected, such as various ones of the polyolefins, for example, polyethylene, polypropylene, and the like. As desired, hinge 84 can be made from the same material as the receptacle and cover, or can be different, as known in the art of hinging thin-section polymeric elements.

Receptacle 80 and cover 82 can be any thicknesses desired so long as the receptacle and cover can be hinged as described, and wherein the gripping structure can be configured to effectively grip the lacing elements. A range of thicknesses can be so defined for each material which is suitable for use in the clasp; and the range of thicknesses depends on the material selected for use in making the clasp.

In another set of embodiments, not show in the drawings, a one-way clasp, otherwise similar to clasp 78 of FIGS. 1–10, is used. In the one-way clasp, edges 102, 104, 106, and 108 are cooperatively structured and configured such that at least one of the side edges, receptacle or cover, at each of the left and right sides of the clasp, is structure, oriented, arranged and configured so as to act as a one-way control gate, or control valve, whereby the respective edge or edge portion flexes outwardly away from the clasp when a lacing element/loop is drawn forwardly through the clasp, in tightening the lacing element on the shoe; and to flex backward, and thereby pinch the lacing element against the other edge which defines the slot, when the lacing element is urged in the opposite, backward direction.

Such structure can include, for example, a flexible edge which has a pinching rest position with an outward flexibility with respect to the clasp. As pulling force, tightening the lacing elements, is relaxed, the side edges of the receptacle and cover retract from their flexed conditions, and act as gripping elements, gripping the lacing elements at slots 110, 112.

Another exemplary structure on one of the cover and receptacle has a rigid edge, but the edge projects outwardly and generally downwardly across the slot opening, to define a tapering slot width, the cross-section thus being constant in the width direction between apertures 114 and varying top-to-bottom, when viewed along the direction of travel of the lacing element. The slot thus presents one or more of the edges 102, 014, 106, 108 at the slots 110, 112 as contact surfaces, flat or arcuate, wherein the contact surfaces project toward/into the respective top/bottom surfaces lacing elements as the lacing elements are urged backward through the slot. In such structure, the dimension across the slot opening is such as to pinch the lacing element, but the flat or arcuate surfaces facilitate forward movement of the lacing, while the projecting edges dig into the lacing element when the lacing element is pulled backward, thus preventing such backward movement.

Figure 12:
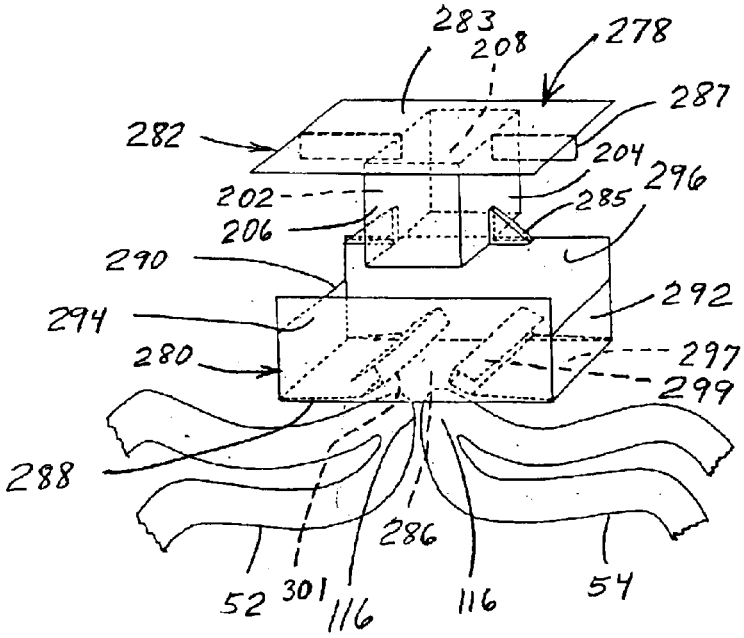
FIG. 12 is a pictorial displacement view of a second clasp useful in lacing systems of the invention, with lacing loops in position just prior to being threaded into and through the clasp, and with the cover displaced from the receptacle.
Figure 13:
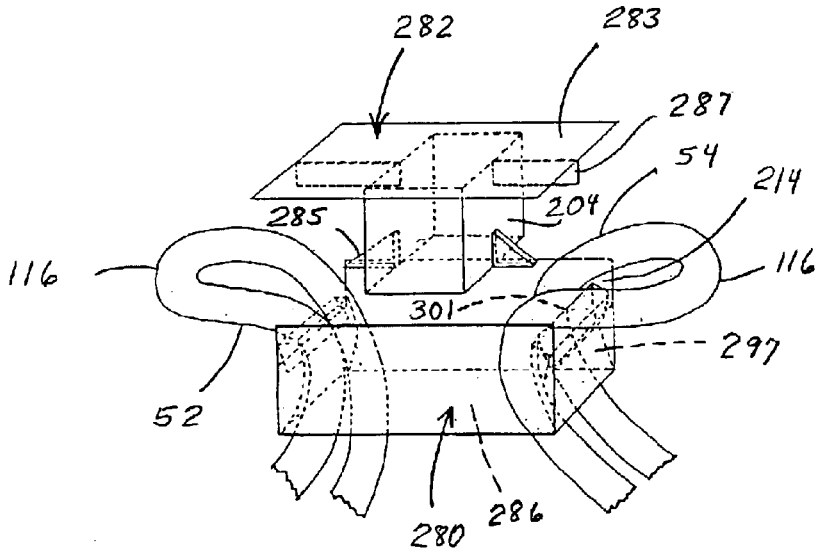
FIG. 13 is a pictorial displacement view of the clasp of FIG. 12, with the lacing loops threaded through the receptacle, and the cover positioned over, and displaced from, the receptacle, ready for emplacement on the receptacle.

FIGS. 12–17 illustrate a second embodiment 278 of the clasp, and its use in the invention. In order to distinguish the clasp of FIGS. 12–17 from the clasp of FIGS. 1–11, a prefix "2" is used in designating certain of the elements of clasp. As seen in FIGS. 12 and 13 clasp 278 includes a receptacle 280, and a cover 282 as a separate and distinct element. Receptacle 280 has a bottom wall 288, a foreshortened left side wall 290, a foreshortened right side wall 292, a full height front wall 294, and a full height back wall 296. Bottom wall 288 comprises gripping flaps 297 which depend from left and right sides of the receptacle at the bottom of the receptacle and function as gripping structure in the embodiment of FIGS. 12–17. Gripping flaps 297 extend inwardly from left and right edges of the bottom of the receptacle.

The rest position of flaps 297 is generally aligned with the plane of the bottom of the receptacle as illustrated in FIG. 12. Left and right folds 299 on left and right flaps 297 create receiving aperture 286. As flaps 297 are raised from the rest position of FIG. 12 toward the draw-in position of FIG. 13, the raising develops a resilient restorative force urging the flaps back toward the rest position of FIG. 12.

Cover 282 includes a top panel 283, and left 202, right 204, front 206, and back 208 side walls depending downwardly from top panel 283. Ramped ears 285 extend outwardly to the left and the right from the left and right side walls. Loop retainers 287 extend down from left and right sides of top panel 283, adjacent left and right side walls 202 and 204, and centered front to back on side walls 202 and 204.

FIG. 12 shows clasp 278 with the cover lifted slightly away and with the loop ends 116 juxtaposed adjacent receiving aperture 286 of the receptacle, and with gripping flaps in their rest position generally aligned with the bottom of the receptacle.

FIG. 13 shows loop ends 116 threaded through the clasp. Loop ends 116 enter the receptacle at receiving aperture 286 and extend upwardly from the receiving aperture and out of the clasp at the left and right exit openings 214 between the top wall and the foreshortened left and right side walls 290, 292 of the receptacle.

Figure 14:
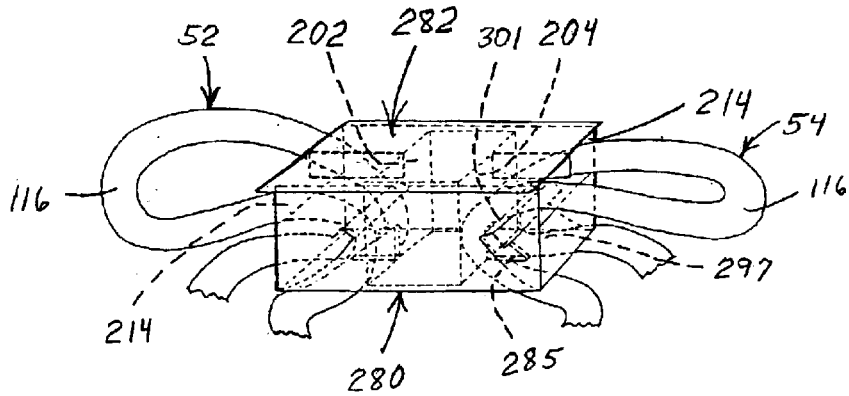
FIG. 14 is a pictorial view showing the lacing loops and clasp of FIGS. 12 and 13 with the cover in place on the receptacle, and actively controlling movement of the lacing elements through the clasp.
Figure 15:
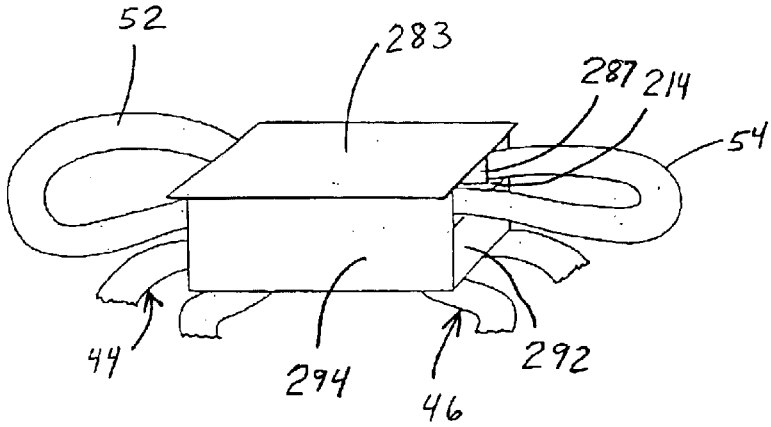
FIG. 15 is an exterior pictorial view of the clasp and lacing loops arrangement of FIG. 14.

As the loop ends are pulled away from each other, and away from the clasp, gripping flaps 297 are flexed upwardly as shown in FIG. 13. Once the loops are properly threaded through clasp 278, cover 282 is installed over the receptacle as shown in FIG. 14, with ramped ears 285 under flaps 297. When the cover is installed on the receptacle as shown in FIG. 14, the resilient biasing force of gripping flaps 297 urges the gripping flaps against the left and right side walls 202, 204 of the cover. Lacing loops 52, 54 are trapped, e.g. pinched, between the gripping flaps 297 and the left and right side walls 202, 204 of the cover, with the resilient restorative forces in the gripping flaps urging the lacing loop elements against the side walls of the cover.

In such condition, the loop ends 116 can be pulled away from each other thus to draw the loops tight as described for the embodiment of FIGS. 1–11. By contrast, as a lacing element begins to move backward through the clasp, the respective lacing element is drawn against the respective distal edge 301 of the respective gripping flap 297, and catches on the distal edge of the respective lacing flap such that the lacing element cannot slide along the distal edge. As the lacing element pulls against the distal edge, the lacing element begins to deform about the distal edge, whereby the distal edge becomes embedded in the lacing element, and pinched against the respective side wall 202 or 204 of the cover, thereby preventing the lacing element from moving longitudinally of the lacing element past the distal edge of the gripping flap. The lacing element is thus gripped, pinched between the distal edge of the gripping flap and the respective side wall 202, 204 of the cover.

In light of the above described relationship between the gripping flaps and the left and right side walls of the cover, in gripping a lacing element as the lacing element begins to move backward through the clasp, gripping flaps 297 effectively prevent unintentional and casual movement of the lacing elements backward through the clasp when the cover is installed over the receptacle as shown in FIG. 14.

Figure 16:
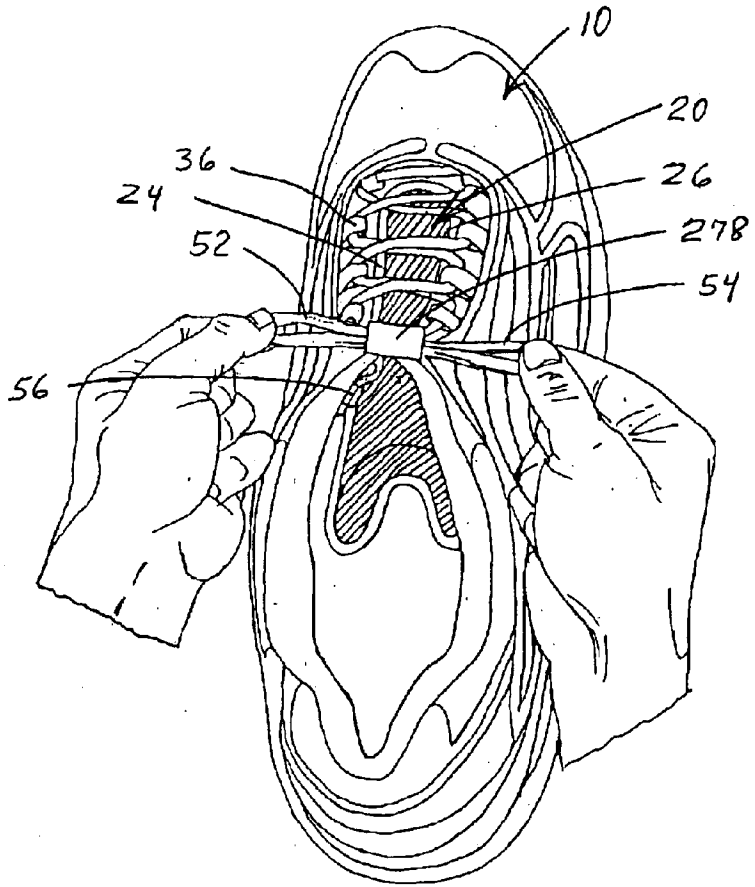
FIG. 16 is a top pictorial view of the shoe lacing system of FIGS. 12–15, with a user pulling the lacing loops tight, and thereby effecting final tightening of the lacing elements on the shoe, similar to the depiction of FIG. 9 for the first embodiment of the clasp.

With the cover so installed, the lacing loops can be pulled in different directions, preferably away from each other, as shown in FIG. 16, as tight as desired in order to bring the lacing elements into tightened relationship along the side edges of expansion opening 20, thus to tighten the shoe about the foot of the wearer. When the tightening force is released, gripping flaps 297 grip the lacing elements and thereby prevent the lacing elements from passing backward through the clasp and becoming unintentionally loosened on the shoe.

Figure 17:
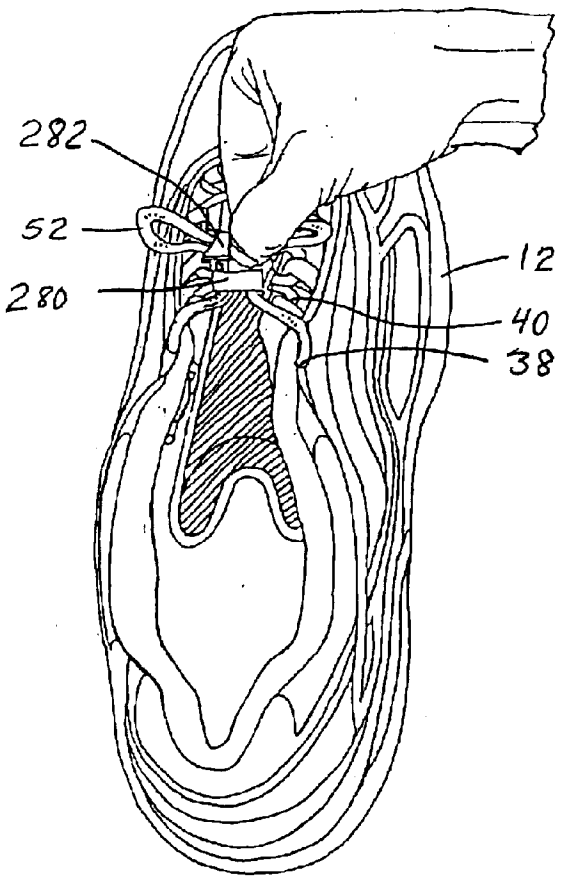
FIG. 17 is a top pictorial view of the shoe lacing system of FIGS. 12–16, showing the cover being raised at initiation of release of the lacing elements from the gripping control of the gripping structure.

When it is desired to release the lacing elements from the tight grip of gripping flaps 297, cover 278 is raised as shown in FIG. 17. As the cover is raised, ramped ears 285 lift upwardly on gripping flaps 297, releasing the lacing elements from the grip of the gripping flaps, thereby enabling the lacing elements to move longitudinally backward through the clasp.

Where it is desired simply to loosen the lacing elements, the cover is raised only a modest distance, e.g. less than half the height of the clasp, to release the lacing elements. In such position, loop retainers 287 intercept loop ends 116 and prevent the loop ends from traversing backward through the clasp, whereby the loops are prevented from inadvertently becoming unthreaded from clasp 278.

The invention can be embodied in a lacing kit of one or more lacing elements in combination with a clasp. The kit can be employed to provide lacing on a shoe having suitable eyelets, either as original equipment on the shoe, or as replacement lacing on a shoe which is previously fitted with conventional lacing.

The eyelets can be arranged in any suitable manner on the shoe body. The eyelets illustrated pass the lacing elements front to back through the eyelets. Other known conventional, and acceptable, eyelet arrangements pass the lacing elements between the inner surface of the shoe body and the outer surface of the shoe body.

The eyelets can be made of any material otherwise suitable for the eyelets of a shoe.

The lacings and lacing elements can be any lacing or lacing element otherwise suitable for lacing a shoe.

As used herein, "lacing" refers to the collective elongate structure which is threaded through, or otherwise wound or attached to lacing eyelets which are built into the shoe.

As used herein, the phrase "lacing element" refers to one or more elements of a lacing. Thus, a lacing can extend through eyelets on both sides of the expansion opening as first and second lacing elements. In such case, the lacing typically crosses between sides of the expansion opening at or adjacent the end of the expansion opening which is closer to the toe of the shoe.

In the alternative, the lacing can be comprised of first and second separate and distinct lacing elements, each separately attached to the shoe body. In such case, the respective lacing elements are typically fixedly attached to the shoe at or adjacent the proximal end of the expansion opening. Such attachment can be permanent or temporary. Preferably, the attachment is temporary, thus accommodating the installation of new lacing elements if and when a given lacing element wears out.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. In combination, a shoe, and a lacing system incorporated into the shoe, (a) said shoe comprising (i) a shoe body (12), (ii) a left side (14) and a right side (16), (iii) an aperture (18) for inserting a wearer's foot therethrough for putting the shoe on and taking the shoe off, (iv) an elongate expansion opening (20) having a distal end (22) in communication with the aperture, left (24) and right (26) sides of the expansion opening being defined by left (28) and right (30) edges of respective left and right upper sides of the shoe body, and (v) a plurality of eyelets (36) being arrayed along the left and right upper sides of the shoe body, adjacent the left (28) and right (30) edges of the expansion opening (20), including terminal eyelets (38) adjacent the distal end of the expansion opening and next adjacent eyelets (40) next adjacent the terminal eyelets (38), the terminal eyelets (38) and the next adjacent eyelets (40) being those eyelets closest to the distal end (22) of the expansion opening and which are used for lacing purposes;

(b) the lacing system comprising (vi) first and second lacing elements (44, 46), including respective first and second lacing ends (48, 50), laced through the eyelets (36) along the left and right upper sides of the shoe body (12), said first (44) and second (46) lacing elements being secured with respect to the shoe body (12) such that the respective lacing elements 44, 46 cannot, in routine lacing use, be removed from the shoe body (12), the first and second lacing elements defining first (52) and second (54) lacing loops, the first and second lacing loops being threaded through a clasp (78, 278) along respective first and second different threading paths, with first and second loop ends (116) emerging from the clasp (78, 278), each loop having a first loop element extending between the clasp and a first one of the eyelets, and a second loop element extending between the clasp and the shoe body or a second one of the eyelets, the first and second loops passing through the clasp along paths according to which pulling the first and second loop ends in first and second different directions draws portions of the loop elements through the clasp.

2. A combination as in claim 1, the first and second loops (52, 54) being defined by lacing elements (44,46) extending outwardly away from the shoe body through a next adjacent eyelet and thence inwardly through a terminal eyelet.

3. A combination as in claim 2, at least one of the lacing elements (44, 46) being anchored to the shoe body (12) at a location on the respective lacing element (44,46) which is between the respective lacing end (48, 50) and a portion of the lacing element (44,46) which is adjacent the terminal eyelet (38).

4. A combination as in claim 1, at least one of the lacing elements (44, 46) being anchored to the shoe body (12) inside the foot-receiving cavity (70).

5. A combination as in claim 1, at least one of the lacing elements being anchored to the shoe body (12) inside the foot-receiving cavity by a mechanical holding device (56).

6. A combination as in claim 5 wherein the mechanical holding device (56) operates as an enlargement of the respective lacing element (44,46), thereby blocking passage of an end of the lacing element (44,46) entirely out of the foot-receiving cavity (70) through the respective eyelet (36).

7. A combination as in claim 5 wherein the mechanical holding device (56) is secured to the lacing element (44,46) and is anchored to the shoe body (12) at a location displaced from the terminal eyelet (38).

8. A combination as in claim 1, at least one of the lacing elements (44, 46) being anchored to the shoe body (12) by adhesive.

9. A combination as in claim 1, the lacing loops (52, 54) entering the clasp (78, 278) at relatively lower locations in upright use orientation of the clasp, and emerging from the clasp at relatively higher locations.

10. A combination as in claim 1, the lacing loops (52, 54) traversing said clasp (78, 278) in non-crossing paths.

11. A combination as in claim 1, the lacing loops (52, 54) traversing said clasp (78) along mirror-image paths.

12. A combination as in claim 1, the lacing loops (52, 54) entering the clasp (78, 278) through a common centrally-disposed receiving aperture (86, 286) and exiting the clasp at exit apertures on opposing sides of the clasp.

13. A combination as in claim 1, said clasp (78, 278) comprising a receptacle (80, 280), receiving the lacing elements (44,46), and gripping structure (97) which grips the lacing elements (44,46) and thereby temporarily prevents withdrawal of the lacing elements (44,46) from the clasp (78, 278).

14. A combination as in claim 5, said clasp (78,278) comprising a clasp receptacle (80, 280), receiving the lacing elements (44,46), and gripping structure (97) which grips the lacing elements (44,46) and thereby temporarily prevents withdrawal of the lacing elements (44,46) from the clasp (78, 278).

15. A combination as in claim 13, said clasp (78,278) further comprising a cover (82, 282), wherein said cover (82, 282) can be opened and closed over said receptacle (80, 280), and wherein closing said cover (82, 282) positions said gripping structure (97,297) for engaging said lacing elements (44,46).

16. A combination as in claim 15, said receptacle (80,280) and said cover (82, 282) being structured such that raising said cover (82, 282) releases said lacing elements (44,46) from engagement with said gripping structure (97).

17. A combination as in claim 15, said gripping structure (97) being defined at least in part by said cover (82).

18. A combination as in claim 15, said gripping structure (97,297) being defined at least in part by said receptacle (80,280).

19. A combination as in claim 15, said cover (82) being hingedly attached to said receptacle (80).

20. A combination as in claim 1, the lacing loops (52, 54) entering the clasp through a receiving aperture (86) and exiting the receptacle at first and second exit apertures (114) on opposing sides of the clasp, and wherein structures communicating with the first and second exit apertures operates, at least in part, as said gripping structure.

21. A combination as in claim 1, said clasp comprising exit apertures (114), and wherein said gripping structure is in communication with said exit apertures such that the lacing elements can move between said exit apertures and said gripping structure when said clasp is configured for gripping said lacing elements.

22. A combination as in claim 1, said clasp comprising first and second exit apertures on a first side of said clasp, and a first gripping slot between said first and second exit apertures, said clasp further comprising third and fourth exit apertures on a second opposing side of said clasp, and a second gripping slot communicating with said third and fourth apertures.

23. A combination as in claim 22 wherein said slots (110, 112) connect with the exit apertures (114) at elevations displaced from vertical mid-points of the exit apertures, such that when the lacing loops (52, 54) are pulled away from the clasp in horizontal directions, side edges of the exit apertures (114) interfere with movement of the lacing loops (52, 54) into the slots (110, 112).

24. A combination as in claim 23 wherein the slots (110, 112) connect with the exit apertures (114) below the vertical mid-points of the exit apertures.

25. A combination as in claim 15 wherein said gripping structure (97) comprises at least one slot (110, 112) in said clasp (78,278) between said receptacle (80, 280) and said cover (82, 282), expandable by translation of said cover (82, 282) with respect to said receptacle (80, 280).

26. A combination as in claim 25, further comprising exit apertures (114) on opposing sides of said clasp (78), in communication with the at least one slot (110, 112).

27. A combination as in claim 1, said clasp (78,278) further comprising at least one loop retainer effective to engage operative ends of the first (52) and second (54) loops, thereby to prevent inadvertent withdrawal of the first (52) and second (54) loops entirely out of said clasp (78,278).

28. A combination as in claim 12, said gripping structure (297) comprising a one-way mechanical lacing gripper, enabling said lacing elements (44, 46) to pass through said clasp (278) along one or more paths extending away from the receiving aperture (286) and preventing casual withdrawal of said lacing elements (44,46) from said clasp (278).

29. A combination as in claim 15 wherein said cover (282) is a separate and distinct element, separable from said receptacle (280) for alternating closing said clasp (278), and opening said clasp (278) for access to said receptacle (280).

30. A combination as in claim 15, further comprising latch structure (98, 100) on at least one of said receptacle (80) and said cover (82), and wherein said receptacle (80) and said cover (82) are cooperatively structured such that closure of said cover (82) over said receptacle (80), secured by said latch structure (98, 100), positions said gripping structure (97) for gripping engagement with said lacing elements (44,46).

31. A method of handling lacing operations on a shoe (10), the shoe having a shoe body (12), a left side (14), a right side (16), an aperture (18) for inserting a wearer's foot therethrough for putting the shoe on and taking the shoe off, an elongate expansion opening (20) having a distal end (22) in communication with the aperture (18), left (24) and right (26) sides of the expansion opening (20) being defined by left (28) and right (30) edges of respective left and right upper sides of the shoe body (12), an array of eyelets (36) being disposed along an upper portion of each of the left (28) and right (30) sides of the shoe body (12), adjacent the left and right edges of the expansion opening (20), including terminal eyelets (38) adjacent the distal end of the expansion opening, and next adjacent eyelets (40) next adjacent the terminal eyelets (38) in each array, the terminal eyelets (38) and the next adjacent eyelets (40) being those eyelets closest to the distal end (22) of the expansion opening (20) and which are used for lacing purposes, the method comprising:

(a) threading first and second lacing elements (44, 46) through the eyelets (36) along the left and right upper sides of the shoe body (12) including establishing a loop (52, 54) of the respective lacing element (44,46), outside the foot-receiving cavity (19), between the shoe body (12) and a corresponding eyelet (38,40) adjacent the distal end (22) of the expansion opening (20), so as to define first and second lacing loops (52,54) which are disposed outside the shoe body (12) and which can extend loosely between the respective eyelet (38,40) and the shoe body (12);

(b) securing the first and second lacing elements (44,46) to the shoe body (12) such that the respective lacing elements (44,46) cannot, in routine lacing use, be removed from the shoe body (12);

(c) threading the first and second loops (52, 54) into and through a clasp (78, 278) along first and second different threading paths so as to establish first and second loop ends emerging from the clasp (78,278), each loop (52,54) having a first loop element extending loosely between the clasp (78, 278) and a first one of the eyelets (36, 38, 40), and a second loop element extending loosely between the clasp (78, 278) and the shoe body (12) or a second one of the eyelets, the first and second loops passing through the clasp (78, 278) along paths according to which pulling the first and second loop ends in first and second different directions can draw portions of the loosely-extending loop elements through the clasp (78, 278);

(d) pulling the first and second loop ends in the first and second different directions so as to draw the loosely extending loop elements through the clasp (78, 278), and thereby to draw the clasp (78, 278) toward the shoe body (12) and tighten the lacing elements (44,46) on the shoe body (12), and correspondingly to draw the left and right upper sides of the shoe body (112) toward each other, along the elongate expansion opening (20); and (e) engaging portions of the first and second lacing elements (44,46), at the lacing loops (52, 54), with respective lacing gripping structure (97,297) at the clasp (78, 278), whereby the lacing gripping structure (97, 297) temporarily retains the lacing loops (52, 54) in the tightened configuration.

32. A method as in claim 31, the pulling of the first and second loop ends in the first and second different directions comprising pulling the respective loop ends (116) from the clasp (78,278) toward the respective left and right sides (14, 16) of the shoe body (12).

33. A method as in claim 31, including threading the first and second loops (52, 54) into the clasp (78, 278) through a common centrally-disposed receiving aperture (86, 286).

34. A method as in claim 31, further comprising releasing the lacing gripping structure (97) from engagement with the lacing loops (52, 54), and with the lacing loops so released, traversing the lacing loops (52, 54) backward through the clasp (78, 278) so as to re-establish the first and second loosely extending loop elements, whereby the loosely extending loop elements enable drawing the left and right sides (14, 16) of the upper portion of the shoe body away from each other at the elongate expansion opening (20) thereby to enable expanding the expansion opening (20), which facilitates the wearer putting the shoe on or taking the shoe off.

35. A method as in claim 31, further comprising, to establish the first and second loops (52, 54), threading the first and second lacing elements (44, 46) each outwardly away from the shoe body (12) through a next adjacent eyelet (40) and then inwardly through a terminal eyelet (38).

36. A method as in claim 31, comprising anchoring at least one of the first and second lacing elements (44,46) to the shoe body (12) at a location on the respective lacing element (44,46) which is between the respective lacing end (48,50) and a portion of the lacing element (44,46) which is adjacent the terminal eyelet (38).

37. A method as in claim 31 comprising anchoring at least one of the first and second lacing elements (44,46) to the shoe body (12) inside the foot-receiving cavity (19).

38. A method as in claim 32 wherein releasing the lacing elements (44, 46) from engagement with the lacing gripping structure (97) comprises moving a portion of the respective lacing element (44,46) transversely along a slot (110, 112) in the clasp to an exit aperture (114) sufficiently large to accommodate withdrawal of the lacing element (44,46).

39. A method as in claim 34 wherein the clasp (78, 278) comprises a cover (82, 282) and wherein raising the cover (82, 282) effectively releases the lacing elements (44,46) from the gripping structure (97,297).

40. A method as in claim 39 wherein the gripping structure (97) is embodied, at least in part, in the cover (82), and wherein raising the cover (82) raises respective parts of the lacing gripping structure (97) away from the lacing elements (44,46) of the loops (52, 54).

41. A method as in claim 40, comprising engaging the gripping structure (97) by drawing the lacing elements (44,46) tight while the lacing elements (44,46) are engaged with one-way lacing gripping structure (97), and wherein the one-way lacing gripping structure (97), while so engaged, prevents the lacing elements (44, 46) from moving backward through the lacing gripping structure (97) to loosen the lacing elements (44,46).

42. A method as in claim 31, the clasp comprising exit apertures (114) on opposing sides thereof, and gripping slots (110, 112) communicating with the exit apertures at slot entrances, the pulling of the first and second loop ends in first and second different directions comprising pulling the loop elements (52, 54) out of alignment with the slot entrances.

43. A method as in claim 42, further comprising, when the lacing elements are desirably tight on the shoe, moving the lacing loops into alignment with the entrances to the slots (110, 112).

44. A method as in claim 39, comprising disengaging the gripping structure by moving the lacing elements (44,46) transversely along respective slots (110, 112) of the lacing gripping structure (97) to exit apertures (114) displaced from each other, the exit apertures (114) having cross-section sizes sufficiently great to accommodate withdrawal of the lacing elements (44,46) backward through the clasp (78) so as to loosen the loops (52, 54) at the left and right sides of the expansion opening.

45. A method as in claim 31, the clasp comprising a receptacle (80) and a cover (82), and wherein tightening the lacing elements (44,46) on the shoe (10) comprises engaging latch structure (98, 100) on one of the cover (82) and the receptacle (80) with the other of the cover (82) and the receptacle (80), and subsequently pulling the loop ends in opposing directions.

46. A method as in claim 34, releasing the lacing elements (44,46) from the clasp (78) comprising moving opposing portions of each lacing loop (52, 54) in opposing directions transversely across the clasp (78) to exit apertures (114) which are sufficiently large to accommodate withdrawal of the lacing element (44,46), and thence moving the lacing element (44,46) backward through the clasp (78) at the exit aperture (114).

47. A method as in claim 31, the retaining of the lacing elements (44,46) in the clasp (78, 278) by the gripping structure (97) being effected by pinching the lacing elements (44,46) at the respective lacing gripping structure (97).

48. A method as in claim 37, the anchoring of a such lacing element (44, 46) to the shoe body (12) further comprising cutting off an end portion (74) of the lacing element (44,46).

49. A method as in claim 31, substantially as herein disclosed herein.

* * * * *